US010214957B2

(12) United States Patent
Morton et al.

(10) Patent No.: US 10,214,957 B2
(45) **Date of Patent: *Feb. 26, 2019**

(54) INSULATED WINDOW ASSEMBLY

(71) Applicant: Deceuninck North America, LLC, Monroe, OH (US)

(72) Inventors: Philip G. Morton, Germantown, OH (US); Jonathan G. Morton, Carlisle, OH (US)

(73) Assignee: Deceuninck North America, LLC, Monroe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/401,435

(22) PCT Filed: May 14, 2013

(86) PCT No.: PCT/EP2013/059950

§ 371 (c)(1),
(2) Date: Nov. 14, 2014

(87) PCT Pub. No.: WO2013/171218

PCT Pub. Date: Nov. 21, 2013

(65) Prior Publication Data

US 2015/0128498 A1 May 14, 2015

Related U.S. Application Data

(63) Continuation of application No. 13/472,275, filed on May 15, 2012, now Pat. No. 8,931,537.

(51) Int. Cl.
*E06B 9/264* (2006.01)
*E06B 3/26* (2006.01)
(Continued)

(52) U.S. Cl.
CPC ..... *E06B 9/264* (2013.01); *E05D 15/28* (2013.01); *E06B 3/2605* (2013.01); *E06B 3/38* (2013.01);
(Continued)

(58) Field of Classification Search
CPC ..... E06B 9/264; E06B 2009/364; E06B 2009/2643; E06B 2007/026; E06B 3/26;
(Continued)

(56) References Cited

U.S. PATENT DOCUMENTS 1,067,146 A * 7/1913 Schoell ..... E06B 9/52 160/92
2,040,049 A * 5/1936 Kahn ..... E06B 7/04 454/217
(Continued)

FOREIGN PATENT DOCUMENTS

DE 219028 2/1910
DE 956 743 1/1957
(Continued)

*Primary Examiner* — Blair M Johnson
(74) *Attorney, Agent, or Firm* — Levy & Grandinetti

(57) ABSTRACT

A main support frame is formed from sections of a plastic extrusion and has opposite side portions with peripheral recesses receiving an inner sash unit and outer sash unit each having a frame formed from sections of a plastic extrusion and supporting an insulated glass unit. Hinges support the dual sash units for pivotal movement between open and closed positions, and gear connected telescopic link members connect the main frame to the sash frames for simultaneous movement. A lock system includes a handle on the inner sash unit for moving straps with studs on the sash frames through a connector mechanism mounted on the main frame for simultaneously locking and releasing both sash units and for releasing only the inner sash unit. A screen and/or mini-blind can be supported between the sash units,
(Continued)

and the window system with dual sash units may be constructed in various forms.

14 Claims, 10 Drawing Sheets

(51) Int. Cl.

| | |
|---|---|
| ***E06B 3/38*** | (2006.01) |
| ***E05D 15/28*** | (2006.01) |
| *E06B 3/36* | (2006.01) |
| *E06B 3/50* | (2006.01) |
| *E05D 3/12* | (2006.01) |
| *E06B 7/02* | (2006.01) |
| *E05F 11/16* | (2006.01) |
| *E06B 3/32* | (2006.01) |
| *E06B 9/52* | (2006.01) |
| *E06B 3/34* | (2006.01) |

(52) U.S. Cl.
CPC ..... *E05D 3/122* (2013.01); *E05F 11/16* (2013.01); *E05Y 2201/62* (2013.01); *E05Y 2201/624* (2013.01); *E05Y 2800/122* (2013.01); *E05Y 2800/205* (2013.01); *E05Y 2800/21* (2013.01); *E05Y 2800/455* (2013.01); *E05Y 2900/148* (2013.01); *E06B 3/325* (2013.01); *E06B 3/36* (2013.01); *E06B 3/5027* (2013.01); *E06B 9/52* (2013.01); *E06B 2003/262* (2013.01); *E06B 2003/343* (2013.01); *E06B 2007/026* (2013.01); *E06B 2009/2643* (2013.01)

(58) Field of Classification Search
CPC ..... E06B 3/38; E06B 7/02; E06B 1/36; E06B 7/16; E05Y 2800/455; E05Y 2900/148; E05C 19/00; E05C 7/00; E05C 17/025; E05C 1/10
USPC ..... 160/107, 96, 92; 49/73.1, 61, 62, 63, 65, 49/67, 68, 98, 104, 107, 108, 116, 163, 49/394
See application file for complete search history.

(56) References Cited

U.S. PATENT DOCUMENTS

| | | | | |
|---|---|---|---|---|
| 2,838,109 | A * | 6/1958 | Persson | E06B 9/264 160/107 |
| 4,941,288 | A | 7/1990 | Morton | |
| 5,003,747 | A | 4/1991 | Morton | |
| 5,226,256 | A * | 7/1993 | Fries | E05B 47/0012 49/13 |
| 6,055,782 | A | 5/2000 | Morton et al. | |
| 6,357,186 | B1 * | 3/2002 | Gould | E06B 7/14 52/209 |
| 6,826,871 | B2 | 12/2004 | Morton et al. | |
| 7,621,082 | B2 | 11/2009 | Morton | |
| 7,975,432 | B2 | 7/2011 | Morton et al. | |

FOREIGN PATENT DOCUMENTS

| | | |
|---|---|---|
| DE | 299 14 475 | 2/2001 |
| DE | 101 40 060 | 3/2003 |
| FR | 2202219 | 5/1974 |
| GB | 672397 | 5/1952 |

* cited by examiner 86
88
107
143
144
136
138
142
106
174
172
178
130
176
150
154
132
120
122
146
124
126

INSULATED WINDOW ASSEMBLY

This Application is the U.S. National Phase of International Application Number PCT/EP2013/059950 filed on May 14, 2013, which claims priority to U.S. patent application Ser. No. 13/472,275 filed on May 15, 2012.

BACKGROUND OF THE INVENTION

In the construction of window units or assemblies using extrusions of plastics materials such as polyvinylchloride (PVC), for example, as disclosed in U.S. Pat. No. 4,941,288, U.S. Pat. No. 5,003,747, U.S. Pat. No. 6,055,782, U.S. Pat. No. 6,826,871 and U.S. Pat. No. 7,975,432 which issued to the inventor and assignee of the present invention, it has been found desirable to provide an operable window unit or assembly which significantly increases thermal conductivity resistance, windload resistance, storm-driven debris impact resistance and also an increased barrier to sound transmission. It has also been found desirable to provide a window assembly with increased air and water infiltration resistance, forced entry resistance, and an increased protection from infrared and ultraviolet light. Furthermore, it is desirable to provide all of these desirable features in a window unit or assembly that is convenient to use as well as economical in construction. While operable window assemblies have been produced or proposed that provide some of the above features, none of the assemblies provides all of the desirable features and advantages mentioned above.

SUMMARY OF THE INVENTION

The present invention is directed to an improved insulated window assembly that provides all of the desirable features and advantages mentioned above. In accordance with one embodiment of the invention, the assembly includes a main support frame for installing in an opening of a building structure and constructed of sections of extruded plastics material and which has opposite side portions defining an inner peripheral cavity or recess and an outer peripheral cavity or recess. A set of parallel spaced sash units include a pair of sash frames that are also constructed of sections of an extruded plastics material and are positioned within the recesses, with each sash frame enclosing parallel spaced insulated glass panels. One set of hinges connect the inner sash unit to one of the frame members and a second set of hinges connect the outer sash unit to one of the frame members of the main support frame and support the sash units for movement between open and closed positions where the sash frames are sealed by weather seals contacting the opposite side portions of the main frame.

A set of elongated telescoping link members connect the inner sash frame and the outer sash frame to the main support frame with the telescoping link members connected to a set of opposing gears to provide simultaneous movement of the inner sash unit and the outer sash unit. A lock system includes a handle member adjacent the inner sash frame and operates a lock connector within the main support frame to release both the inner sash frame and outer sash frame and to secure and compress both sash frames to the opposite side portions of the main frame in response to movement of the handle from an open position to a closed position.

Other features and advantages of the invention will be apparent from the following description, the accompanying drawings and the appended claims.

DESCRIPTION OF THE ILLUSTRATED EMBODIMENTS

Figure 16:
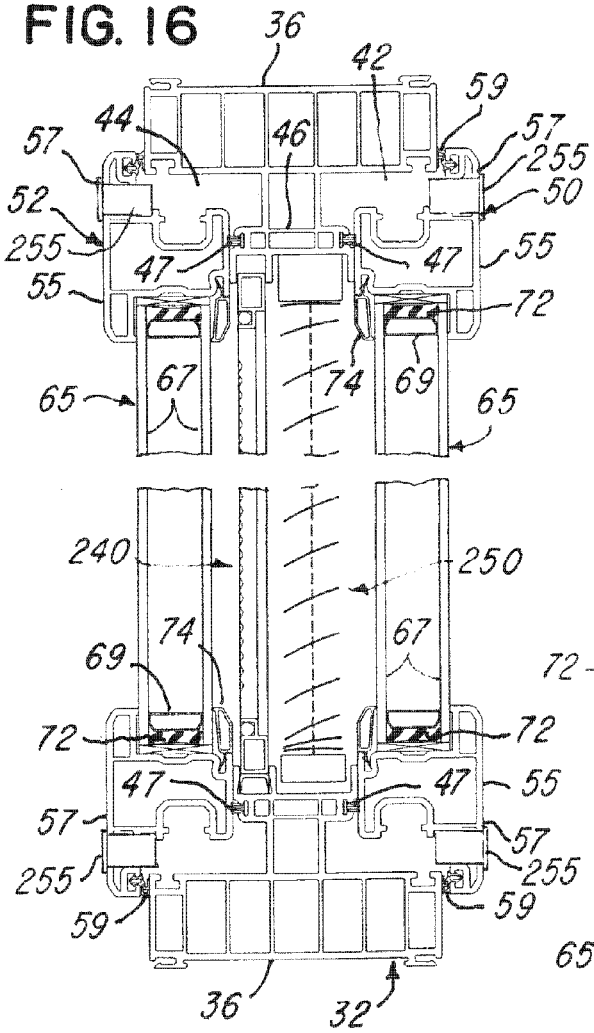
FIG. 16 is a vertical section of the window assembly shown in FIGS. 1 & 2 and showing a screen unit and a mini-blind unit positioned in the dead air space between the closed sash units, and with a center portion of the assembly broken away.
Figure 17:
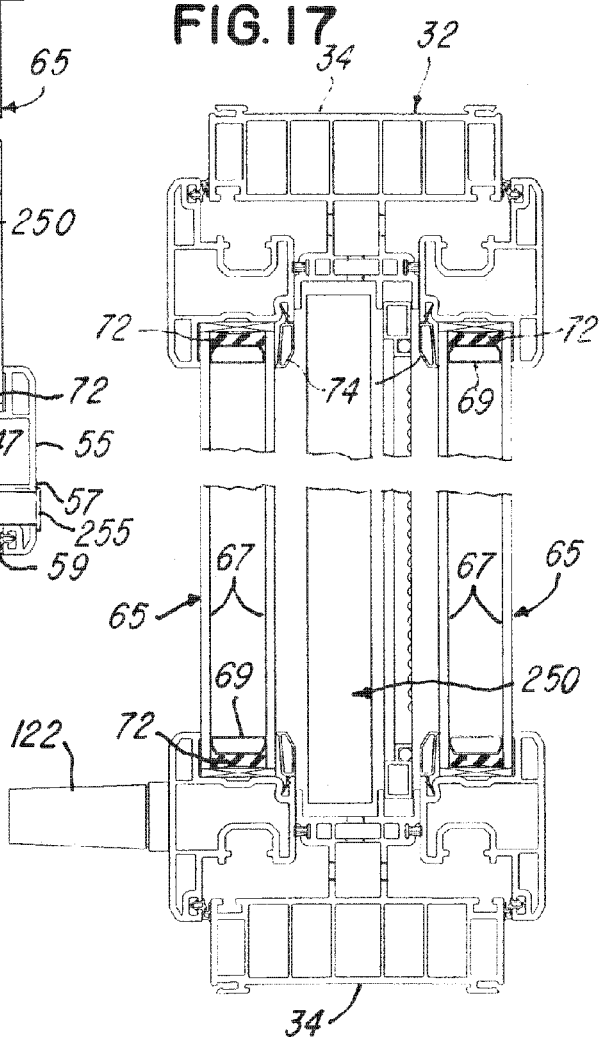
FIG. 17 is a horizontal section of the window assembly shown in FIG. 16.

Referring to FIGS. 1-7, a casement-type window assembly 30 constructed in accordance with the Invention includes a main support frame 32 which is adapted to be installed in an opening of the wall of a building structure. The frame 32 is formed by parallel spaced vertical frame members 34 (FIG. 17) rigidly connected by vertically spaced horizontal frame members 36 (FIG. 16), and the frame members 34 and 36 are formed by sections of extrusions of rigid plastics material such as polyvinyl chloride (PVC). Each of the frame members 34 and 36 has the same cross-sectional configuration or profile, and the frame sections 34 & 36 are connected together in a conventional manner by welded mitered corner joints 38. As shown in FIGS. 16 & 17 the frame members 34 & 36 have opposite side portions defining a rectangular inner cavity or recess 42 and a corresponding rectangular outer cavity or recess 44. Each of the frame members 34 & 36 also includes an integrally extruded and inwardly projecting T-shape center portion 46 (FIG. 16) which supports outwardly projecting weather seals 47 extending around the inner portions of the recesses 42 & 44.

An inner sash assembly or unit 50 is positioned within the inner cavity 42, and an outer sash assembly or unit 52 is supported within the outer cavity 44 of the main support frame 32, as shown in FIGS. 16 & 17. Each of the sash units 50 & 52 includes a rectangular sash frame 55 formed from linear sections of an extrusion of rigid plastics material such as PVC, and the inner and outer sash frames 55 are identical in size and cross-sectional profile. Each of the sash frames 55 includes an outwardly projecting peripheral flange portion 57 which overlaps the main support frame 32 and which supports and carries a peripherally extending weather seal 59. Each of the sash frames 55 also supports a transparent glazing unit 65 which is shown as a dual pane insulated glass unit formed by parallel spaced glass panes of panels 67 separated by a peripherally extending spacer frame 69 and sealed together by peripherally extending bonding material 72, in a conventional manner. The sash frames 55 and insulated glazing units 65 may also be constructed and assembled as disclosed in U.S. Pat. No. 7,621,082 which issued to the assignee of the present invention and the disclosure of which is herein incorporated by reference. The insulated glass or glazing units 65 are removably retained on the sash frames 55 by glazing sealant between the units 65 and the perimeter of the sash frames 55 and by peripherally extending glazing strips 74 formed of extruded plastics material, in a conventional manner.

Figure 8:
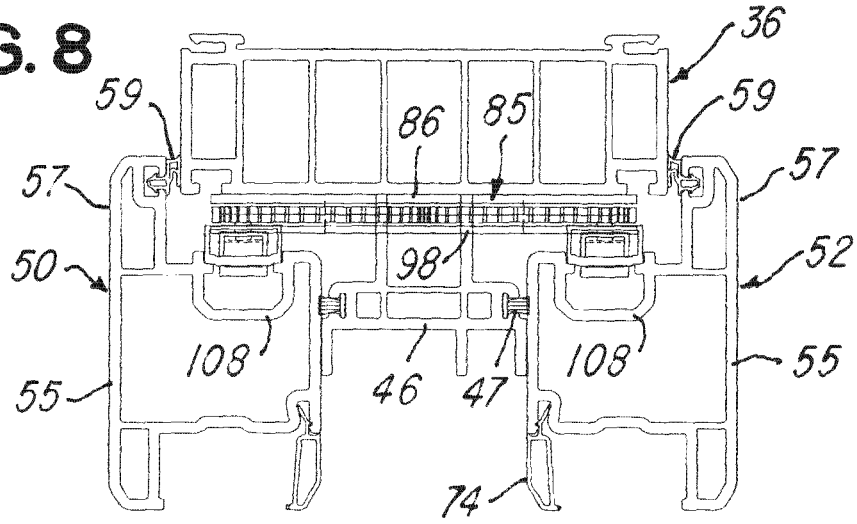
FIG. 8 is a vertical section through the head member of the main support frame and the upper frame members of the sash frames in closed positions.
Figure 9:
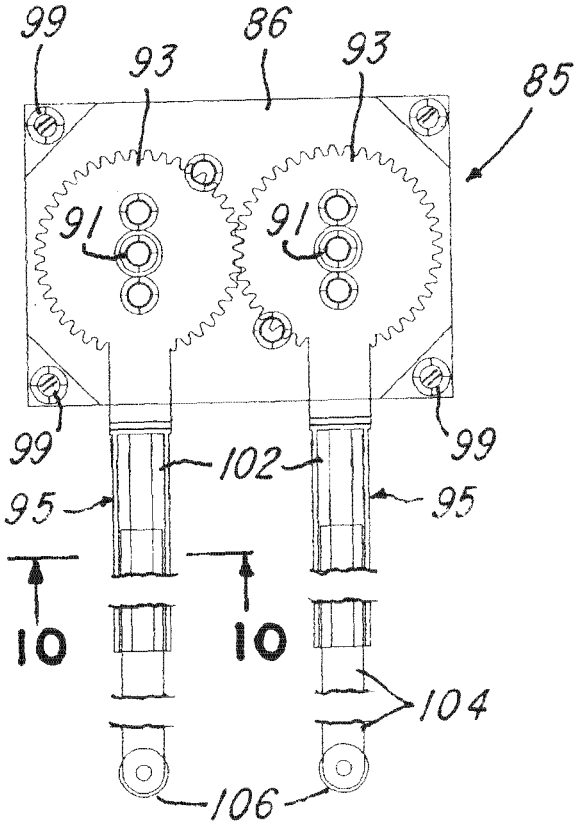
FIG. 9 is a plan view of the gear operated arms for interconnecting the sash frames.
Figure 10:
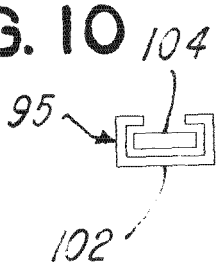
FIG. 10 is a cross section of one of the arms, taken on the line 10-10 of FIG. 9.

Each of the inner sash units 50 and outer sash units 52 are supported for pivotal movement by the set or pair of hidden hinges 78 (FIGS. 4 & 6) connected to a vertical frame member 34 of the main support frame 32, and the hidden hinges 78 are commonly used in the window industry. Referring to FIGS. 5-10, the inner sash unit 50 and the outer sash unit 52 are connected for simultaneous movement between closed positions (FIG. 1) and fully open positions (FIG. 5) by a sash connecting unit 85 (FIGS. 8 & 9). The unit 85 includes a base plate 86 and a cover plate 88 (FIG. 18) connected together by a pair of stub shafts 91 (FIG. 9) which support a pair of flat intermeshing spur gears 93 from which extend a pair of telescopic elongated arms 95. The flat gears 93 are confined between the plates 86 & 88 and with the arms 95 form the sash connecting unit 85. The unit extends horizontally through a slot 98 (FIG. 8) formed within the T-shaped portion 46 of the horizontal head member 36 of the main support frame, and corner portions of the base plate 86 are secured to the head member 36 by a set of fasteners or screws 99.

Figure 14:
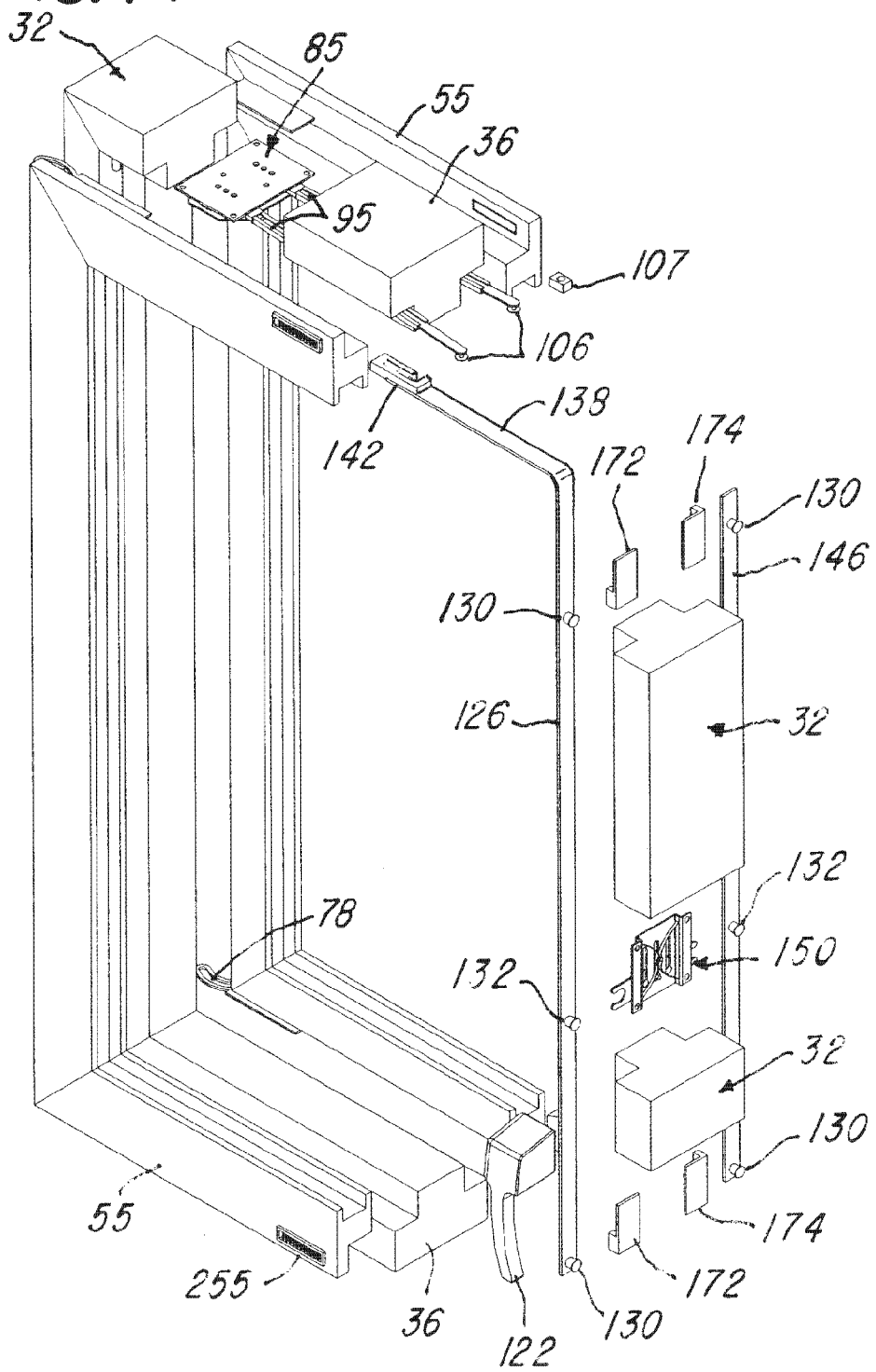
FIG. 14 is an exploded fragmentary and diagrammatic perspective view of the lock system for the sash frames shown in FIG. 5.
Figure 15:
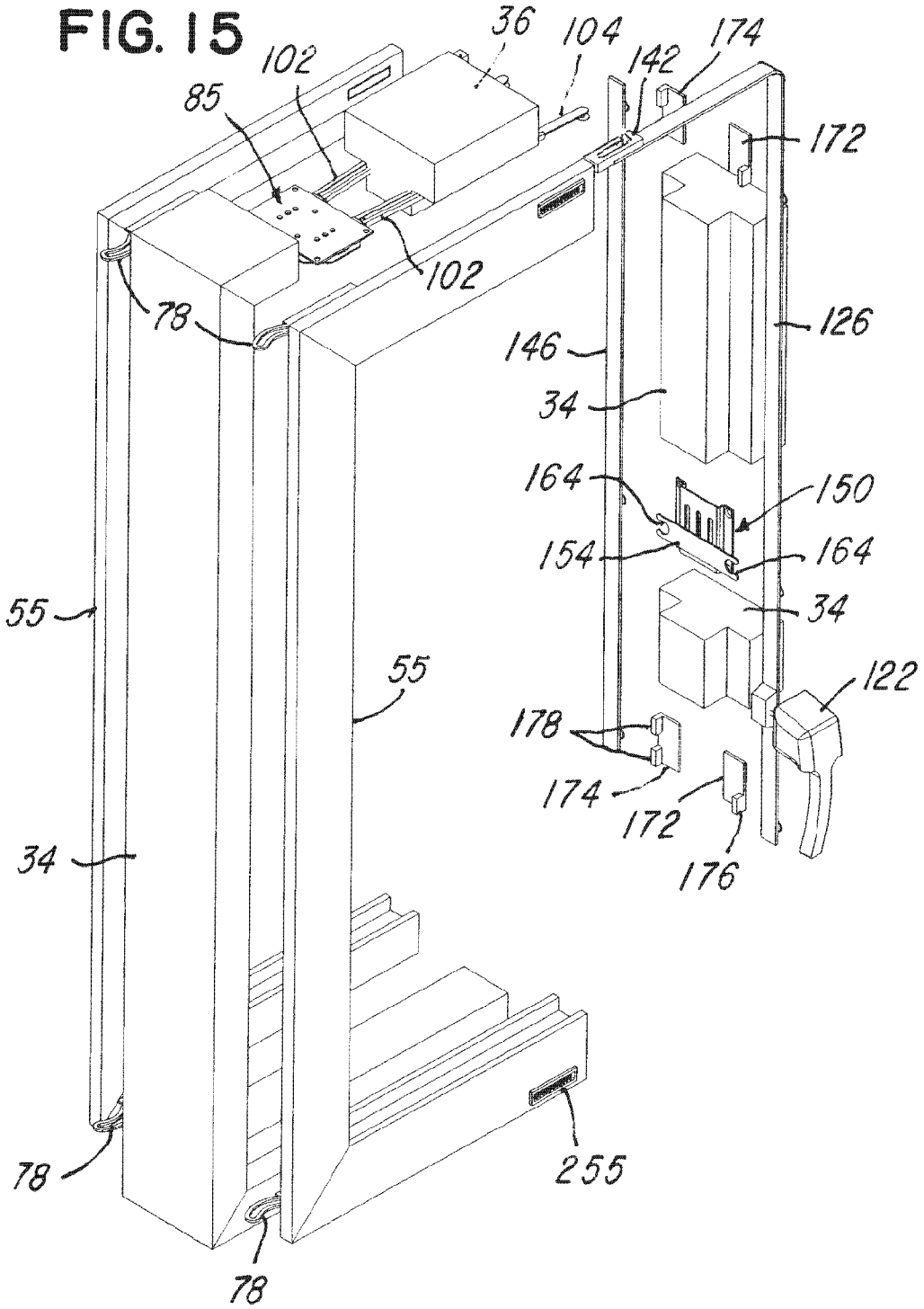
FIG. 15 is another exploded fragmentary and diagrammatic perspective view of the lock system shown in FIG. 14.

Each of the telescopic arms 95 includes a channel member 102 (FIG. 10) which captures and slidably supports a flat arm member or bar 104. The outer end portion of each arm 75 is pivotally connected to the top surface of the corresponding sash frame 55 with a button 106. The button 106 for the outer sash frame 55 connects with a block 107 (FIGS. 14 & 18) retained within a channel portion 108 (FIG. 8) of the sash frame. The pivot connection of the button 106 to the inner sash frame 55 will be described later. Thus as the inner sash unit 50 is moved or pivoted between its closed position and its open position, the sash connecting unit 85 causes the outer sash unit 52 to move or pivot simultaneously between its closed position and open position.

Referring to FIGS. 11-15 and FIGS. 18-20, the inner sash unit 50 and the outer sash unit 52 are simultaneously locked together or unlocked by a lock mechanism or system 120. The system includes a handle member 122 attached to a shaft 123 (FIG. 11) supported for rotation by a gear housing 124 recessed within the outer vertical sash member of the sash frame 55 of the inner sash unit 50. The shaft 123 (FIG. 11) extends through the housing 124 which encloses a gear mechanism (not shown) connected to move an elongated strap 126 (FIGS. 14, 15 & 18-20) which extends vertically within the channel 108 of the vertical sash frame member of the inner sash frame 55.

The vertical strap 126 supports a set of upper and lower locking pins or studs 130 and an intermediate stud 132, and the studs project outwardly into the inner recess 42 within the main support frame member 34. The upper portion of the vertical strap 126 is connected by a curved thin flexible band section 136 (FIGS. 18-20) to a horizontal strap 138 which connects with an inner sash disconnect fitting 142 having a slot 143 which receives the button 106 on the outer end of the arm 95 for the inner sash unit 50. The slot 143 has an end opening 144 through which the button 106 can pass to release the inner arm 95 from the inner sash frame 55. Thus vertical movement of the strap 126 with the studs 130 and 132 is effective to move the strap 138 and fitting 142 horizontally by a short distance within the top frame member of the inner sash unit 50. Straps with spaced studs and with a thin section to extend around a corner of a sash frame are produced by hardware manufacturers such as Interlock USA Corporation in Reno, Nev. and Roto Frank of America, Inc. in Essex, Conn.

Figure 11:
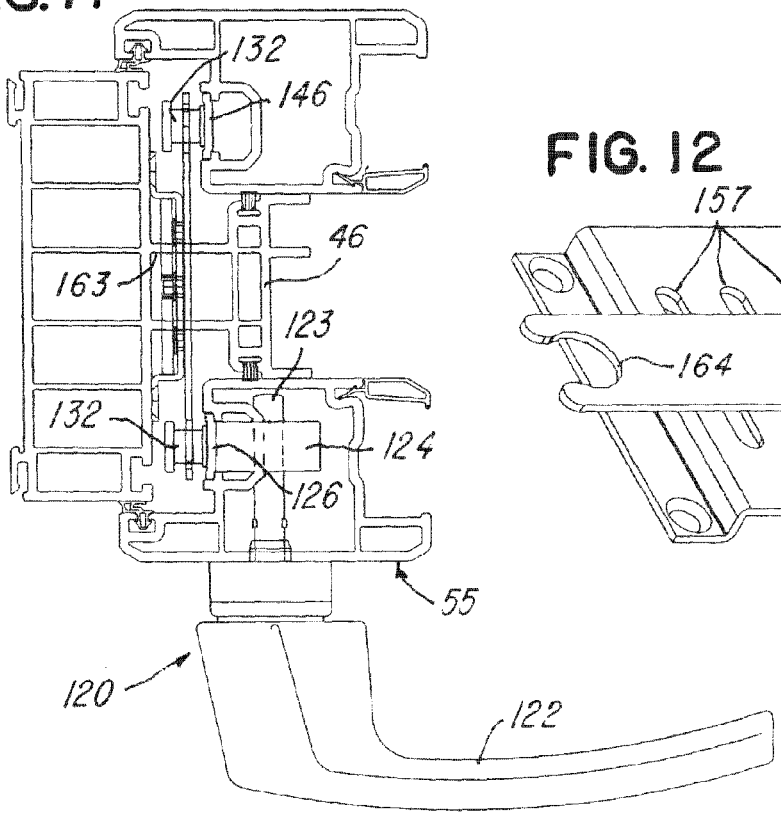
FIG. 11 is the horizontal section of the main support frame and sash frames with the lock system shown in its unlocked position.
Figure 12:
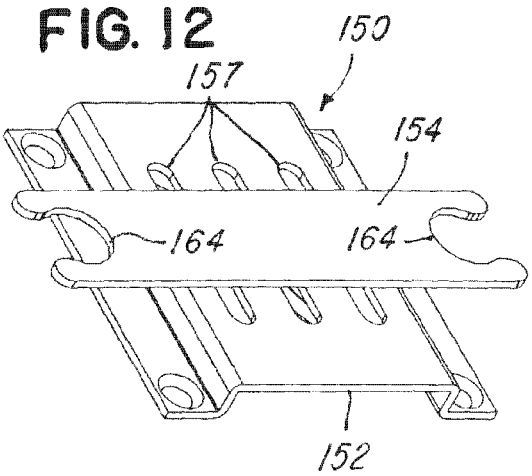
FIG. 12 is a perspective view of the sash connector unit of the lock system for the sash frames.
Figure 13:
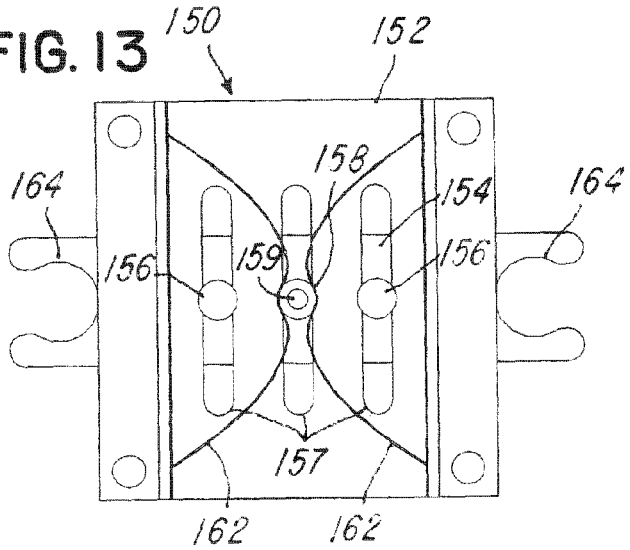
FIG. 13 is an elevational view of the sash connector unit shown in FIGS. 11 & 12.

The lock system 120 also includes a vertical strap 146 (FIGS. 18-20) which extends within the channel 108 of the outer vertical frame member of the outer sash frame 52 and which is shorter than the strap 126. The strap 146 also carries a set of studs 130 and 132 which have the same vertical spacing as the studs on the strap 126. Referring to FIGS. 11-13, the lock system 120 also includes a sash connector unit 150 which is formed by a metal bracket 152 supporting a pivoting actuator member or plate or a sliding actuator member or plate 154 retained on the bracket 152 by two studs 156 (FIG. 13) which project through corresponding slots 157 so that the actuator plate 154 slides on the bracket 152 without twisting or cocking. The actuator plate 154 is also retained on the bracket 152 by a bushing 158 (FIG. 13) retained by a pin 159, and a pair of opposing leaf springs 162 are formed to engage the bushing 158 and form a detent for a center position of the actuator plate 154 on the support bracket 152.

As shown in FIG. 11, the sash connector unit 150 extends through a vertical slot 163 within the T-shape center portion 46 of the outer vertical frame member 34 of the main support frame 32. The unit 150 is positioned so that U-shaped cavities or recesses 164 within opposite end portions of the actuator plate 154 receive the studs 132 on the straps 126 and 146 (FIG. 20) and carried by the sash frames 55 of the inner sash unit 50 and the outer sash unit 52 when the sash units are in their closed positions within the cavities 42 and 44.

Figure 1:
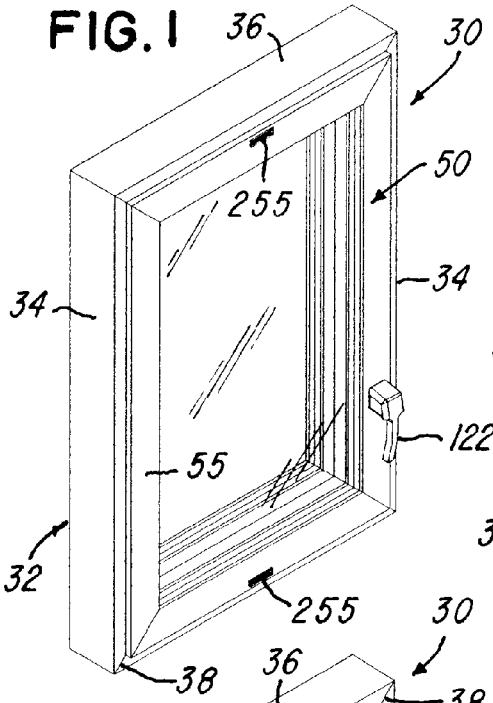
FIG. 1 is a perspective view of an insulated casement window assembly constructed in accordance with the invention.
Figure 2:
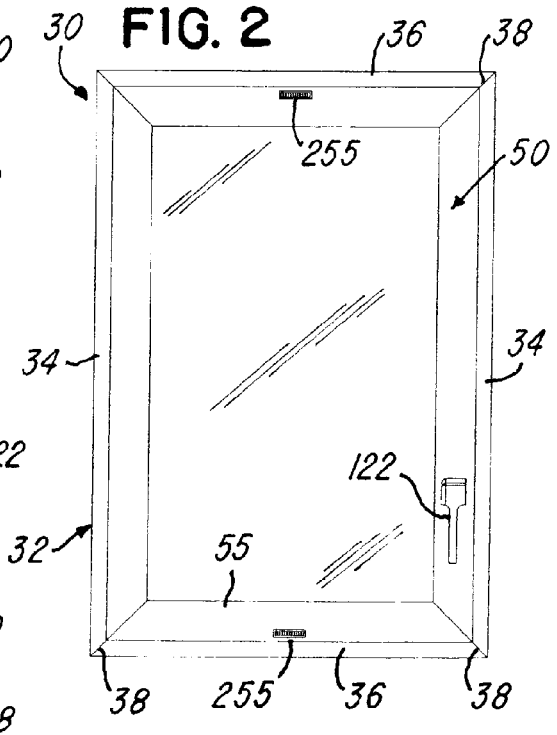
FIG. 2 is a front elevational view of the window assembly shown in FIG. 1.
Figure 3:
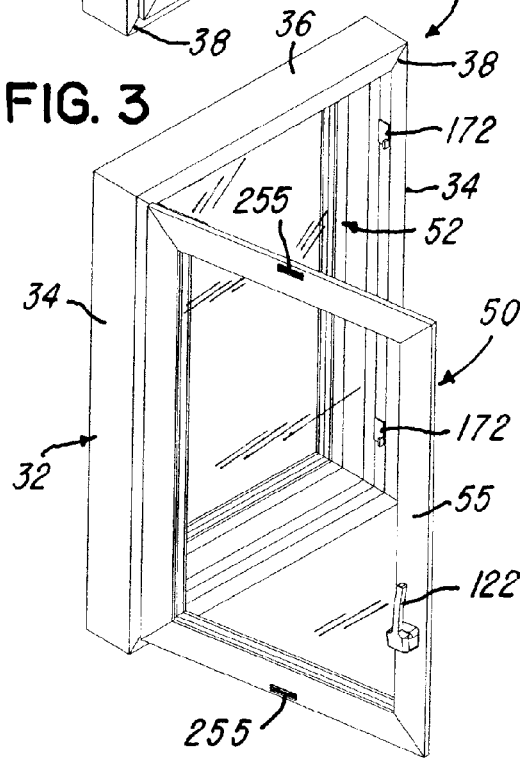
FIG. 3 is a perspective view of the window assembly shown in FIG. 1 and with the inner sash unit shown in an open position.
Figure 5:
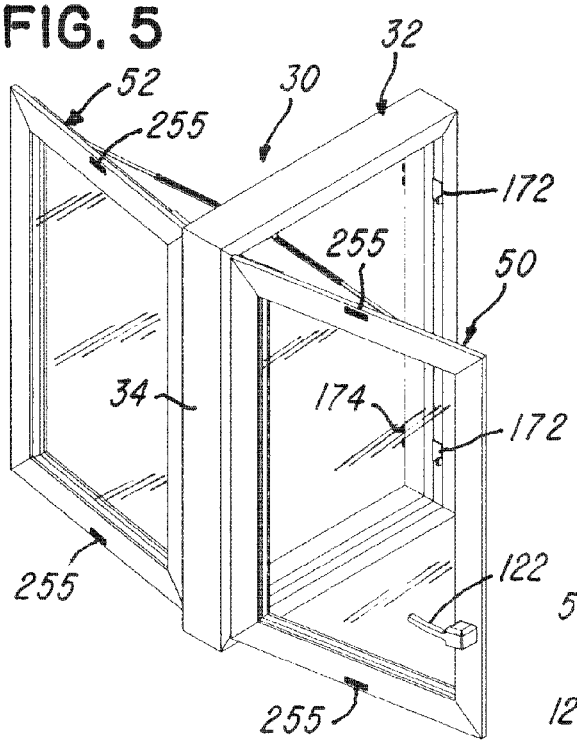
FIG. 5 is a perspective view similar to FIG. 3 and showing both the inner sash unit and the outer sash unit in open positions.
Figure 6:
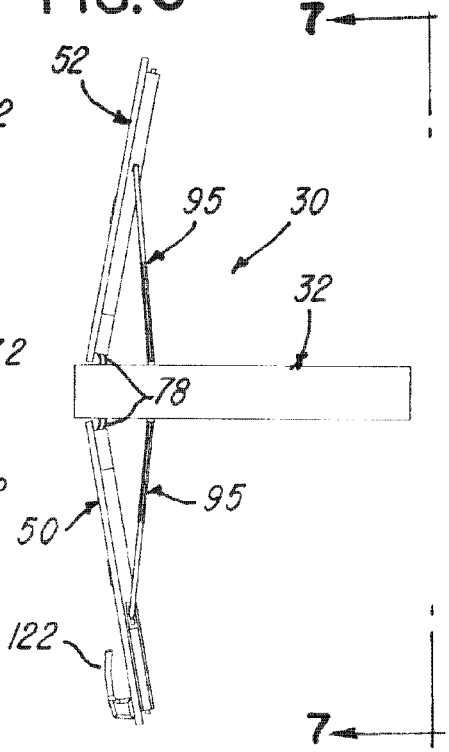
FIG. 6 is a top plan view of the window assembly shown in FIG. 5.
Figure 7:
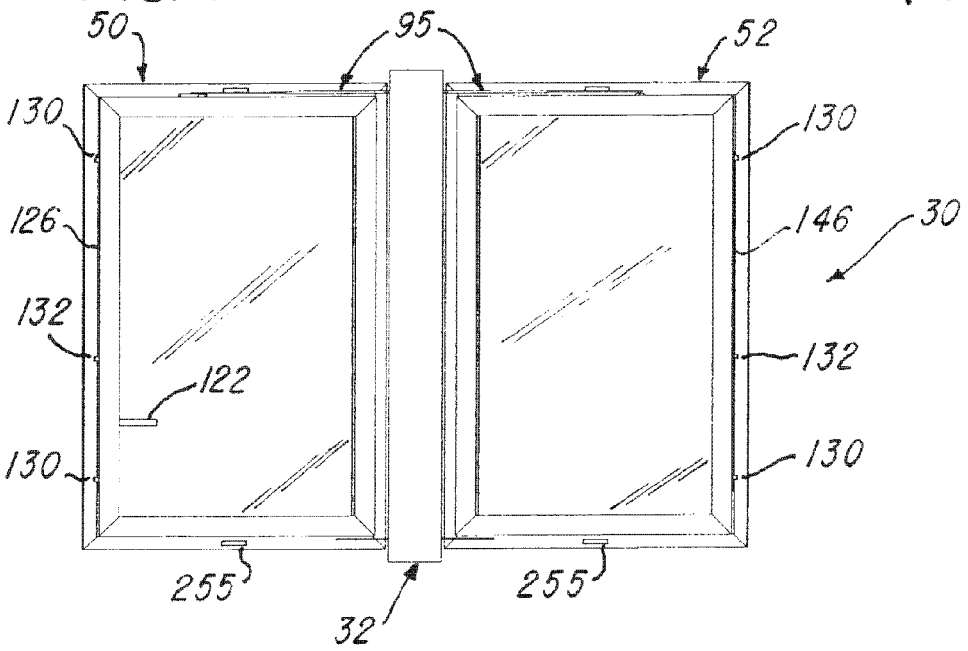
FIG. 7 is an elevational view taken generally on the lines 7-7 of FIG. 6.

As shown in FIGS. 14 & 15 and FIGS. 18-20, the lock system 120 also includes a set of lock keepers 172 and 174 with the keepers 172 for the inner sash frame including a single right angle tab 176, and the keepers 174 for the outer sash frame having a pair of spaced right angle tabs 178. The keepers 172 and 174 are mounted on the outer vertical frame member 34 of the main support frame 32, as shown in FIGS. 3 & 5, and the tabs 176 and 178 function to block the studs 130 on the straps 126 and 146 on the inner and outer sash frames 55 when the straps 126 and 146 are shifted vertically downwardly to locked positions (FIG. 18) for the inner and outer sash units 50 & 52.

Figures 18, 19, 20:
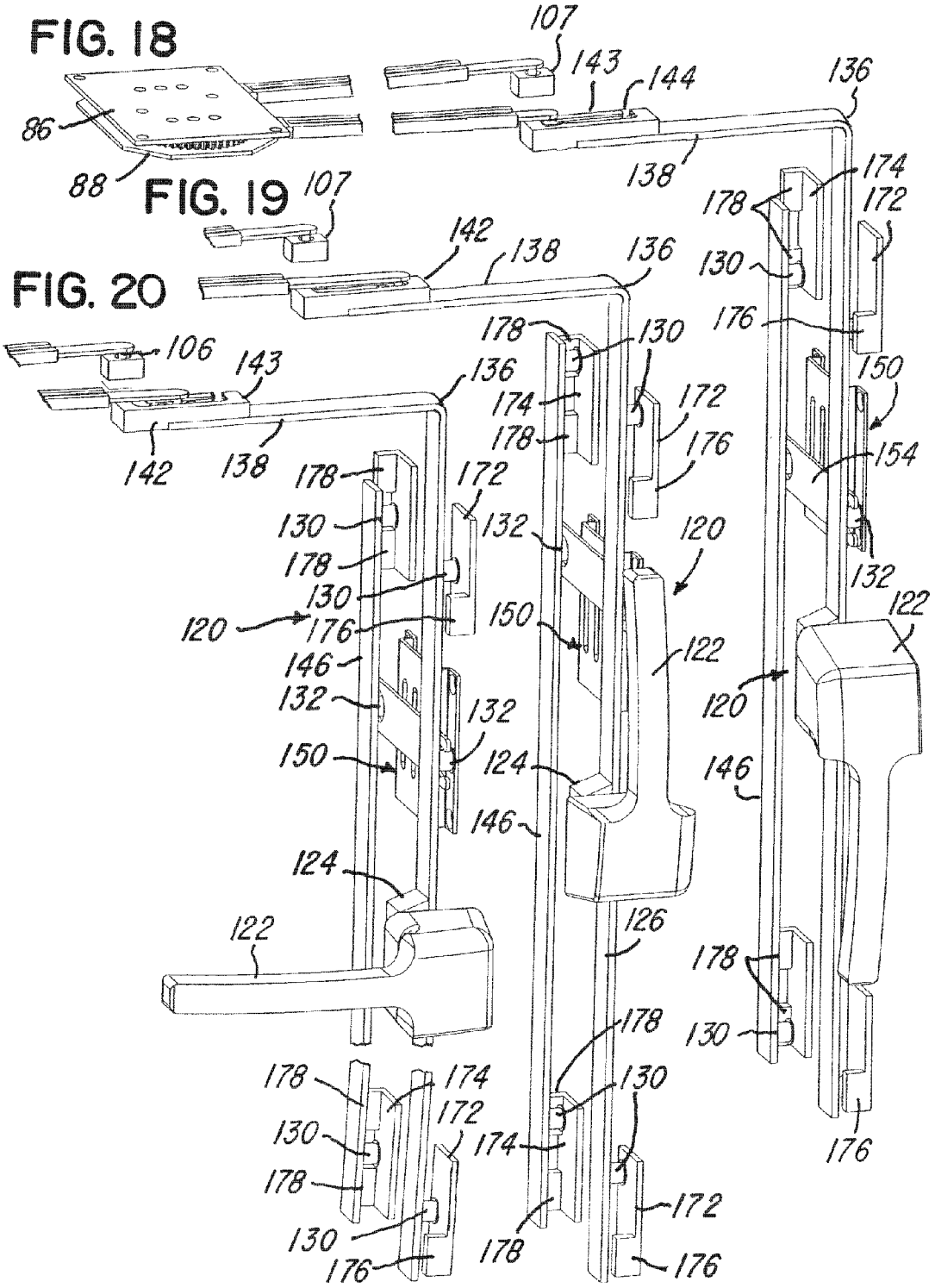
FIGS. 18, 19 and 20 are fragmentary diagrammatic perspective views of the lock system incorporated in the window assembly shown in FIGS. 1-7.

As also shown in FIGS. 18-20, the handle 122 of the lock system 120 has three active positions. When the handle 122 is down (FIG. 18), the straps 126 and 146 are positioned where the upper and lower studs 130 on each strap on the sash frames are located behind the tabs 176 and 178 of the keepers 172 & 174 so that both the inner and outer sash frames are locked in their closed positions. The straps 126 & 146 move vertically together in the same direction in response to rotation of the handle 122 as a result of the sash connector unit 150. If the sash connector unit has a pivoting actuator plate, the straps 126 and 146 move in opposite directions. When the studs 130 are shifted behind the tabs 176 on the keepers 172 and the lower tabs 178 on the keepers 174, the sash frames are cammed inwardly by the tabs to compress or snub the sash frames 55 against the weather seals 47 to form a fluid-tight seal between each sash frame 55 and the main support frame 32.

When the handle member 122 is rotated to a horizontal position (FIG. 20), the straps 126 and 146 are shifted upwardly to open positions for the sash units where the studs are 130 are no longer behind the tabs 176 & 178. In the horizontal open position, the handle member 122 may be pulled to pivot the inner sash unit 50 to its open position (FIGS. 5-7) and simultaneously the outer sash unit 52 pivots to its open position as a result of the sash interconnecting unit 85 described above in connection with FIGS. 8-10.

When the handle member 122 is moved from its closed or down position (FIG. 18) 180 degrees to its upwardly projecting position (FIG. 19), the straps 126 and 146 move to their uppermost positions through the sash connector unit 150. At this upper position, the studs 130 for the inner sash frame are located above the locking tabs 176 of the keepers 172, and the studs 130 on the strap 146 move behind the upper locking tabs 178 on the keepers 174. As the inner strap 126 moves to it's upper position, the upper horizontal portion 138 of the strap 126 shifts horizontally to move the inner sash disconnect member 142 to a position (FIG. 20) which releases the button 106 on the arm 95 for inner sash frame so that the stud 106 is no longer positively connected to the inner sash frame. The inner sash unit 50 may then be pulled to its open position (FIGS. 3 & 4) while the outer sash unit 52 remains locked to the main support frame 32 in its closed position. In this position of FIG. 19, the sash connecting unit 85 remains in the position shown in FIG. 9 with the arms 95 in substantially parallel relation.

Figure 21:
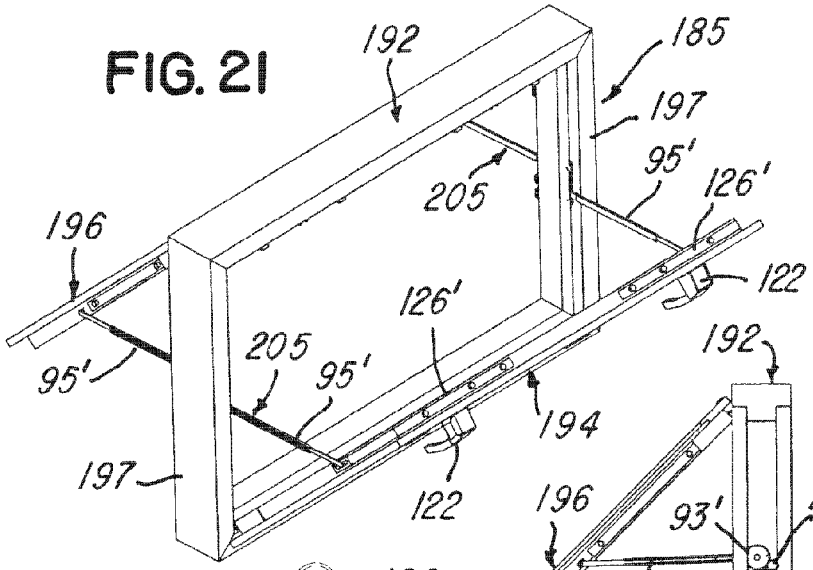
FIG. 21 is a perspective view of an awning/hopper window assembly constructed in accordance with the invention and shown in an open position.
Figure 22:
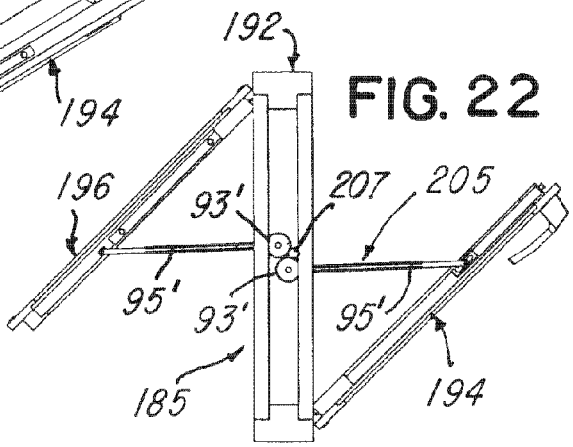
FIG. 22 is a vertical section of the window assembly shown in FIG. 21.
Figure 23:
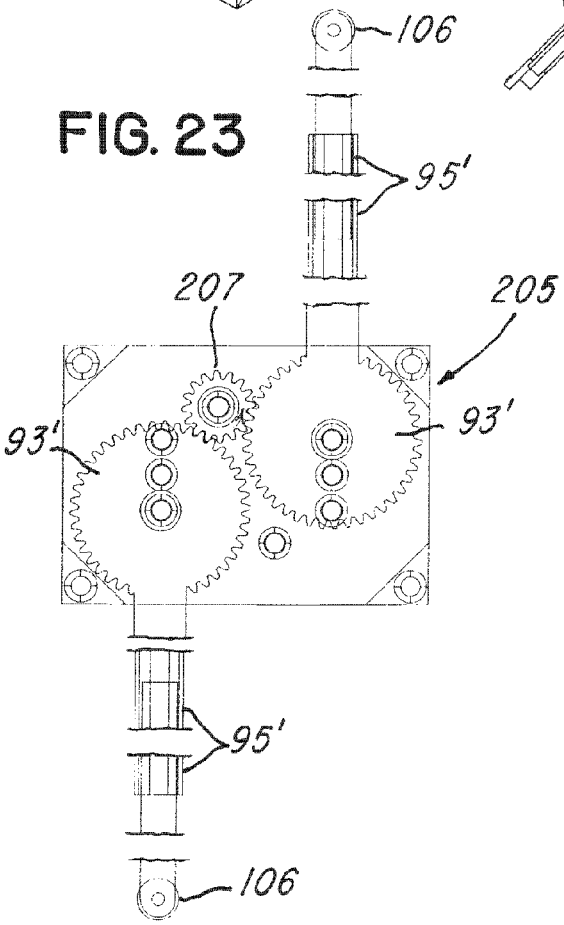
FIG. 23 is an elevational view of the sash connector unit used on the window assembly shown in FIGS. 21 & 22.

Referring to FIGS. 21-23 which illustrates another embodiment of the invention, an awning/hopper window assembly 185 is constructed in the same manner as the casement window assembly 30 disclosed in connection with FIGS. 1-20, but with prime marks on similar parts. The assembly 185 includes a main support frame 192 constructed substantially the same as the main support frame 32. An inner sash unit 194 and an outer sash unit 196 are constructed substantially the same as the inner sash unit 50 and outer sash unit 52. However, the inner sash unit 194 is pivotally supported by a set of hinges connected to the bottom horizontal sash member of the main support frame 192, and the outer sash unit 196 is pivotally supported by a set of hinges connected to the upper horizontal sash member of the main support frame 192. Each of the vertical frame members 197 of the main support frame 192 supports a sash connecting unit 205 (FIG. 23) which is constructed substantially the same as the sash connecting unit 85 except with the addition of an interconnecting spur gear 207 (FIG. 23).

The gear 207 enables the arms 95' to rotate in opposite directions so that when the inner sash unit 194 is pivoted between its closed position and its open position, the outer sash unit 196 simultaneously moves between its closed position and its open position, shown in FIGS. 21 & 22. The inner sash unit 194 is also provided with one or two handle members 122 which actuate or shift corresponding straps 126' recessed in the top frame member of the inner sash unit 194 and in the bottom frame member of the outer sash unit 196 through corresponding sash connector units 150 located within the top frame member of the main support frame 192. Thus when both handle members 122 are in the open positions, tilting movement of the inner sash unit 194 between its closed position and its open position simultaneously move the outer sash unit 196 between its closed position and its open position. Movement of each handle member 122 to its locked position, simultaneously locks the inner sash unit 194 and the outer sash unit 196 to the main support frame 192 by shifting the straps 126 extending around the inner sash unit 194 and the outer sash unit 196.

Figure 24:
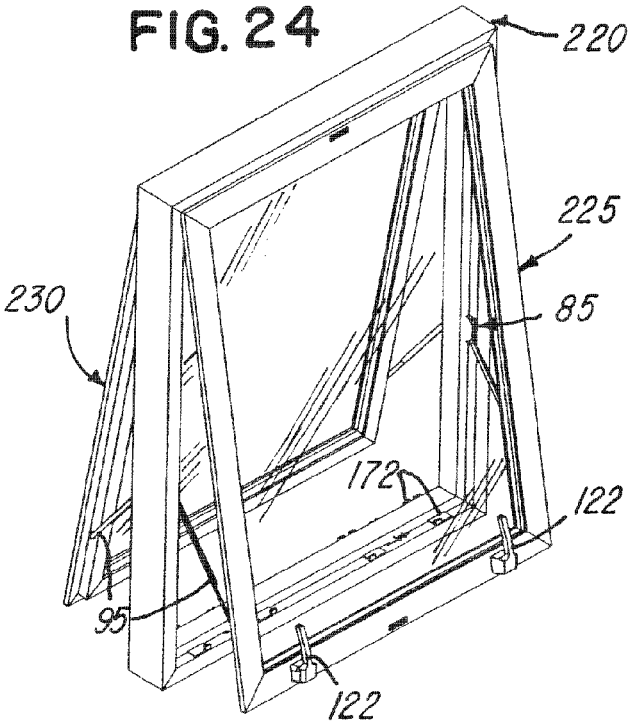
FIG. 24 is a perspective view of a vent window assembly constructed in accordance with the invention and illustrated in an open position.
Figure 25:
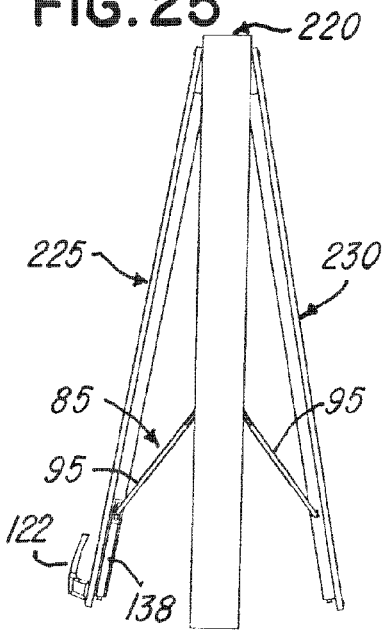
FIG. 25 is an end elevational view of the window assembly shown in FIG. 24.

Referring to FIGS. 24 & 25 which illustrate another embodiment of the invention, a main support frame 220 supports an inner sash unit 225 and an outer sash unit 230 which are both connected to the top horizontal frame member of the main support frame 220 by a set of hidden hinges. A pair of sash connecting units 85 are attached to the vertical frame members of the main support frame 220 and connect the inner sash unit 225 and the outer sash unit 230 for simultaneous pivotal movement between their open and closed positions. To counterbalance the weight of the sash units, air springs may be connected to the vertical sash members of the inner sash unit and to the inner portions of the vertical members of the main frame. The bottom frame members of the sash units 225 and 230 are locked to the bottom frame member of the main support frame 220 by a set of lock systems constructed substantially the same as the lock system 120 described above, but with a pair of lock connectors 150 positioned within the bottom horizontal frame member of the main support frame 220. Thus movement of the handle members 122 between open positions (FIGS. 24 & 25) and closed positions simultaneously locks both of the sash units 225 and 230 to a corresponding set of keepers 172 secured to the bottom horizontal frame member of the main support frame 220.

Figure 4:
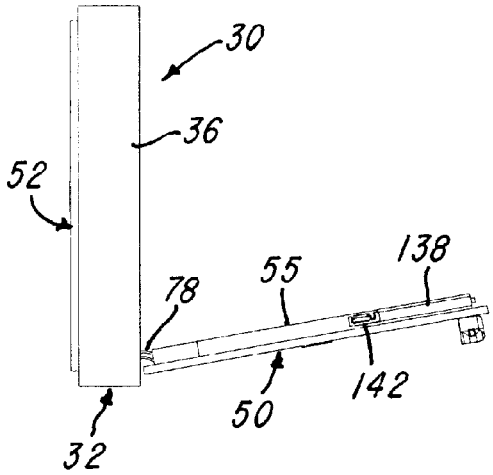
FIG. 4 is a top plan view of the window assembly shown in FIG. 3.

As shown in FIGS. 16 & 17, a screen unit 240 and a retractable and adjustable mini-Venetian blind 250 are supported within the dead air space between the inner sash unit 50 and the outer sash unit 52 thereby protecting the screen unit 240 and blind unit 250. When it is desired to clean, adjust or remove the mini-blind 250 or clean or remove the screen unit 240, the handle member 122 on the inner sash unit 50 is moved to its upper position (FIG. 19) so that the outer sash unit 52 remains locked to the main support frame and the inner sash unit 50 is released for pivoting to an open position, as shown in FIGS. 3 & 4. This is especially desirable in cold weather when it is desired to clean or adjust the mini-blind unit 250 or remove the screen unit 240 while preventing cold outside air from entering through the window assembly.

As shown in FIGS. 1-3, 5 & 7, the top and bottom frame members of the inner sash unit 50 and the outer sash unit 52 are provided with elongated vent units 255 which preferably have a temperature sensing bi-metallic closure member that moves or slides behind spaced vent openings or slots. The purpose of the vent units 255 is to prevent overheating in the dead air space between the inner sash unit 50 and the outer sash unit 52 in the summer and in the winter. The units 255 are calibrated to provide for venting over-heated air by convection through openings in T-shape portion 46 (FIG. 17) of the main support frame 32 to the vent units 255 within the inner sash frame 55 in winter months into the inside of the building, and provide for the escape of heated air through the vent units in the outer sash frame 55 during summer months. One source for the units 255 as designed by the inventors is Smart Vent Products, Inc. in Pitman N.J.

From the drawings and the above description, it is apparent that an insulated window assembly constructed in accordance with the invention provides desirable features and advantages. More specifically, the dual insulated sash units provide significant thermal efficiency by substantially increasing the resistance to thermal conductivity through the window assembly. The dual sash units also significantly increase the resistance to both positive and negative windloads and to storm-driven air born debris impact resistance since one of the sash units always presses tighter against the main support frame in response to either positive or negative windload or debris impact. The dual sash units each having double insulated glass panels and the additional dead air space between the sash units also provide an increased barrier to the transmission of sound energy. In addition, the window assembly provides simple operation by conveniently pulling on one handle on the inner sash unit to open both sash units and pushing the handle to close both sash units. Turning the handle effectively locks and unlocks both sash units to the main support frame and also provides for releasing only the inner sash unit without unlocking the outer sash unit.

The dual insulated sash units having flange portions 57 which overlap the main frame members further provide or increase resistance to forced entry and to water and air infiltration. In addition, the construction of the dual insulated sash units with identical sash frames and glass or glazing units, significant reduces the cost of manufacturing the window assembly since both sash units can be produced at the same time. The dual sash window assembly further provides protection for the window blind unit and the screen unit from being damaged by weather, abrasion or insects and from collecting dust and dirt. It is also within the scope of the invention to fix or lock the outer sash unit of a dual sash casement window assembly so that the outer sash unit does not open and serves as a picture window. The lock system then provides for opening and closing and locking only the inner sash unit to the main support frame and for convenient access to the mini-blind unit and to the outer sash unit for cleaning. An insulated window assembly constructed in accordance with the invention may also be used to form a door assembly which would provide the same advantages described above.

While the forms of window assemblies herein described constitute preferred embodiments of the invention, it is to be understood that the invention is not limited to these precise forms, and that changes made therein without departing from the scope and spirit of the invention as defined in the appended claims.

What is claimed is:

1. An insulated window assembly comprising:

a main support frame for installing in a wall opening of a building structure and formed by parallel spaced vertical frame members rigidly connected by vertically spaced horizontal frame members including an upper frame member and a lower frame member, with said support frame having opposite side portions defining a peripheral inner recess and a peripheral outer recess, an inner sash unit including an inner sash frame positioned within said inner recess and an outer sash unit including an outer sash frame positioned within said outer recess, with each said sash frame enclosing a transparent glazing unit, a set of hinges pivotally connecting each said inner sash unit and said outer sash unit to one of said frame members of said main support frame and supporting each said inner sash unit and said outer sash unit for pivotal movement between an open position and a closed position with said inner sash frame and said outer sash frame sealed by weather seals to said opposite side portions of said main support frame, a set of elongated link members connecting said inner sash unit and said outer sash unit to one of said frame members of said main support frame with said link members being connected to provide simultaneous movement of said inner sash unit and said outer sash unit, and a lock system including a handle member adjacent said inner sash frame and a sash connector within one of said frame members of said main support frame and operable to secure said inner sash unit and said outer sash unit to said opposite side portions of said main support frame in response to movement of said handle member from an open position to a closed position, said lock system comprising an elongated strap member supported by each of said sash frames for longitudinal movement, with each said strap member supporting longitudinally spaced studs, said sash connector includes an actuator member supported within one of said frame members of said main support frame for receiving and engaging one of said studs on said strap member on each of said sash frames, and keeper members mounted on at least one of said frame members of said main support frame for releasably engaging at least one of said studs on said strap member on each of said sash frames for locking each said sash unit in said closed position.

2. The insulated window assembly as defined in claim 1 wherein said link members have first end portions supported for rotation by said one of said frame members of said main support frame, and intermeshing gears connecting said first end portions for simultaneous rotation of said link members.

3. The insulated window assembly as defined in claim 2 wherein said first end portions of said link members are supported for rotation by said upper horizontal frame member of said main support.

4. The insulated window assembly as defined in claim 2 wherein each of said elongated link members comprises a first section and a second section connected for relative telescopic movement, said first section of each said link members having one of said first end portions supported for rotation, and said second section of each of said link members pivotally connected to one of said sash frames.

5. The insulated window assembly as defined in claim 1 wherein said handle member of said lock system has three positions, one position to lock both said inner sash frame and said outer sash frame to said opposite side portions of said main supported frame, a second position to release both said inner sash frame and said outer sash frame from said opposite side portions of said main support frame, and a third position to release only said inner sash frame from said main support frame while the outer sash unit remains closed and locked.

6. The insulated window assembly as defined in claim 1 wherein upper and lower portions of said inner sash frame and said outer sash frame have vent passages with temperature sensing adjustable closure members to permit the escape of overheated air by convection through one or more openings in a portion of the main support frame to the vent passages between said sash units when each of said sash units is in said closed position.

7. The insulated window assembly as defined in claim 1 wherein said vertical frame members and said horizontal frame members of said main support frame comprise sections of an extrusion of plastic material and have substantially the same cross-sectional profile.

8. The insulated window assembly as defined in claim 1 wherein each of said sash frames includes horizontally spaced vertical sash frame members rigidly connected by vertically spaced horizontal sash frame members, and said vertical and horizontal sash frame members comprise sections of an extrusion of plastics material and have substantially the same cross-sectional profile.

9. The insulated window assembly as defined in claim 1 wherein both said inner sash unit and said outer sash unit are pivotally supported by said hinges mounted on one of said vertical frame members of said main support frame.

10. The insulated window assembly as defined in claim 1 wherein said inner sash unit is pivotally supported by said hinges mounted on said horizontal lower frame member of said main support frame, and said outer sash unit is pivotally supported by said hinges mounted on said horizontal upper frame member of said main support frame.

11. The insulated window assembly as defined in claim 1 wherein both said inner sash unit and said outer sash unit are pivotally supported by said hinges mounted on said horizontal upper frame member of said main support frame.

12. The insulated window assembly as defined in claim 1 and including a mini-Venetian blind supported within said main support frame between said inner sash unit and said outer sash unit.

13. An insulated window assembly comprising:

a main support frame for installing in a wall opening of a building structure and formed by parallel spaced vertical frame members rigidly connected by vertically spaced horizontal frame members including an upper frame member and a lower frame member, with said support frame having opposite side portions defining a peripheral inner recess and a peripheral outer recess, an inner sash unit including an inner sash frame positioned within said inner recess and an outer sash unit including an outer sash frame positioned within said outer recess, with each said sash frame enclosing a transparent glazing unit, a set of hinges pivotally connecting each said inner sash unit and said outer sash unit to one of said frame members of said main support frame and supporting each said inner sash unit and said outer sash unit for pivotal movement between an open position and a closed position with said inner sash frame and said outer sash frame sealed by weather seals to said opposite side portions of said main support frame, a set of elongated link members connecting said inner sash unit and said outer sash unit to one of said frame members of said main support frame with said link members having first end portions supported for rotation by said one of said frame members of said main support frame and with intermeshing gears connecting said first end portions for simultaneous rotation of said link members to provide simultaneous movement of said inner sash unit and said outer sash unit, and a lock system including a handle member adjacent said inner sash frame and operable to secure said inner sash unit and said outer sash unit to said opposite side portions of said main support frame in response to movement of said handle member from an open position to a closed position, said lock system comprising an elongated strap member supported by each of said sash frames for longitudinal movement, with each said strap member supporting longitudinally spaced studs, said sash connector includes an actuator member supported within one of said frame members of said main support frame for receiving and engaging one of said studs on said strap member on each of said sash frames, and keeper members mounted on at least one of said frame members of said main support frame for releasably engaging at least one of said studs on said strap member on each of said sash frames for locking each said sash unit in said closed position.

14. The window assembly as defined in claim 13 wherein each of said elongated link members comprises a first section and a second section connected for relative telescopic movement, said first section of each said link members having one of said first end portions supported for rotation, and said second section of each of said link members pivotally connected to one of said sash frames.

* * * * *